United States Patent [19]

Calcar et al.

[11] Patent Number: 5,006,845

[45] Date of Patent: Apr. 9, 1991

[54] GAS KICK DETECTOR

[75] Inventors: Henry V. Calcar, Edmonds, Wash.; Gary L. Marsh, New Orleans, La.

[73] Assignees: Honeywell Inc., Minneapolis, Minn.; Shell Offshore Inc., New Orleans, La.

[21] Appl. No.: 366,093

[22] Filed: Jun. 13, 1989

[51] Int. Cl.[5] ..... G01V 1/00

[52] U.S. Cl. ..... 340/853; 175/48; 166/336; 367/81

[58] Field of Search ..... 175/5, 7, 40, 48; 166/335, 336, 363, 364; 367/81; 340/856, 853

[56] References Cited

U.S. PATENT DOCUMENTS 3,595,075 7/1971 Dower ..... 175/48

4,147,222 4/1979 Patten et al. ..... 175/48

*Primary Examiner*—Charles T. Jordan

*Assistant Examiner*—J. Woodrow Eldred

*Attorney, Agent, or Firm*—Whitham & Marhoefer

[57] ABSTRACT

Methods for the early detection of gas kicks in marine risers (10) include monitoring a downhole absolute pressure and a downhole differential pressure of a riser section (11) positioned just above the blowout preventer (18). The absolute pressure is used to calculate an average density of mud or mud/gas mixture in the entire riser (10). The differential pressure across the riser section (11) is used to calculate an average density of mud or mud/gas mixture in riser section (11). An unfavorable comparison between the calculated density for the mud or mud/gas mixture in the riser section (11) and the calculated density for the mud or mud/gas mixture in the entire riser (10) is used to detect the onset of a gas kick and to alert the operator. Alternatively, the measured differential pressure across the riser section (11) can be compared with an expected downhole differential pressure. Unfavorable comparisons of the measured and expected differential pressures indicate the onset of a gas kick.

17 Claims, 6 Drawing Sheets

GAS KICK DETECTOR

BACKGROUND OF THE INVENTION

1. Field of the Invention

The present invention is generally related to a method and apparatus for the early detection of a gas kick in a well bore and, more particularly, to a method which includes comparing a measured value for the mud density in a riser segment at a point just above the blowout preventer (BOP) with either a measured value of the average mud density in the entire riser or a predicted value of mud density determined from a mud flow dynamics model wherein a gas kick is detected by an unfavorable comparison of the two values.

2. Description of the Prior Art

A riser in an offshore drilling operation is a large section of pipe that extends from a blowout preventer to the sea surface. A drill string runs down through the riser and through the BOP to a rotary drill bit connected at its lower end. The bit may be powered by a surface motor or a down hole motor. Drilling fluid, such as mud, is pumped down the drill string through the drill bit to flush cuttings from the bit as well as to cool the bit. The drilling fluid then flows back up to the surface in the annular space defined first by the well itself, and then by the inside of the riser and the outside of the drill string. Below the blowout preventer, the well may be lined with casings to maintain stability of the formations through which the well is drilled. The bell nipple is the top section of the riser where the drilling fluids are removed. The drilling fluids flow into a tank at the surface where the drill cuttings are separated out and, from time to time, various additives are mixed with the drilling fluids to maintain desired properties therein. A pump then re-circulates the drilling fluids back down the drill string for continued use of the fluids.

During drilling, formation gas may enter the well bore to create a "gas kick". If the gas kick is not detected and controlled it may result in a blowout condition of the well. Previous methods of detecting a gas kick have included monitoring the differential flow of mud during a drilling operation and measuring the circulation pressure. In differential flow detection, a substantial increase in the rate of return mud flow without a corresponding increase in the input flow is indicative of an impending blowout. One drawback with differential flow detection is that long integrating periods are required to observe small differential flow and during this time a large quantity of gas kept compressed to a small volume by the hydrostatic head of the mud above it may move up the well and enter the riser before remedial action can be taken. In circulation pressure detection, the pressure required to circulate the drilling fluid through the well is monitored and represents the sum total of all pressure drops through out the system. Fluctuations in the circulation pressure indicate when substantial changes in well bore conditions have occurred; however, they do not indicate when subtle changes in well bore conditions have occurred. Both differential flow detection and circulation pressure detection are performed near the surface at a point quite remote from the point of compressed gas influx. Moreover, rig heave for the semisubmersible or ship-shape floating rig can complicate surface measurements as can the volume changes due to the additions of additives at the surface and/or removal of excess mud due to additive additions.

U.S. Pat. No. 3,595,075 to Dower discloses a method and apparatus for sensing down hole conditions in a well bore. The circulating pressure and the differential pressure are measured at the surface where the mud is pumped down the drill string. The measured differential pressure is used to compute a drill pipe pressure which should be equivalent to the measured circulating pressure. Differences between the measured and computed drill pipe pressure are indicated by a pair of concentric gauges and are attributable to changes in down hole conditions. The apparatus cannot determine what caused the change and would be insensitive to small changes since 80% of the total pressure drop occurs at the drill bit nozzles.

U.S. Pat. No. 3,760,891 to Gadbois discloses a blowout and lost circulation detector which utilizes trend analysis of the returned rate of flow of the drilling fluid. A pressure sensor and fluid column arrangement is used for flow rate measurement. Detection is accomplished by comparing a current measurement with previous measurements and differences that occur are indicative of changes in the system.

U.S. Pat. No. 3,955,411 to Lawson discloses a method for measuring the average density of drilling fluid columns in marine risers. The hydrostatic pressure of the drilling fluid is measured at a point just above the blowout preventer. It is known from the laws of physics that a column of fluid (liquid or gas) exerts a pressure in all directions which is a function of the density of the fluid and the height of the column. Since the height of the column is known, the density of the fluid in the column can be directly derived from the pressure measurement. This pressure measurement must be corrected for a velocity dependent pressure drop. A column of formation gas entering the well bore and rising to a point above the pressure sensor will result in a reduction in the average density of the fluid column. Measuring the average density of the drilling fluid in a whole riser is not a sensitive method for detecting the onset of a gas kick. In deep water, a substantial amount of gas must enter the riser above the detection point before a noticeable reduction in the average density of the fluid in the riser occurs. By this time, a substantial amount of gas would need to be cleared from the well and riser before normal drilling could be resumed.

U.S. Pat. No. 4,408,486 to Rochon et al discloses a bell nipple densitometer for continuously determining the amount of entrained gas present in drilling mud before the gas is released to the atmosphere. The bell nipple has been modified to accommodate two vertically spaced differential pressure measurement ports. Changes in the differential pressure are proportional to changes in the weight of the drilling mud caused by the presence of entrained gases. The bell nipple densitometer disclosed by Rochon et al is not intended to be used as a gas kick detector and cannot be adapted for use as a gas kick detector since the measurement is made at the top of the riser. Conceivably, the riser could be completely full of gas before any change is detected and at this point a blowout could not be stopped. In addition, the vertically spaced measurement ports are only 8.35 inches apart so that the differential pressure measurement can be directly translated into pounds per gallon of water. This spacing can provide accurate measurements after the gas has expanded as it has by the time it reaches the surface, but it would be inapplicable for measurements made on formation gas 6,000 feet below sea level.

U.S. Pat. No. 4,527,425 to Stockton discloses a system for detecting blowout or lost circulation conditions in a borehole. The system uses a "Doppler effect" to detect the change in flow rate between the mud being pumped down through the bit and the mud circulating up the riser. The measurement technique takes advantage of the fact that during mud flow, phase shifts in sonic signals are proportional to the direction and the rate of mud flow. The advantage of this system is that the measurements are made at the bottom of the borehole where the source of the problem is encountered. However, the Stockton device is designed to detect high pressure fluid influx rather than gas influx. Gas aeration may greatly attenuate the acoustic communication between the transmitter and receiver and; therefore, this method is impractical for detecting gas kicks. Moreover, gas influx is the more dangerous cause of blowouts.

U.S. Pat. No. 4,620,189 to Farque discloses parameter telemetering from the bottom of a deep borehole. A frequency modulated signal of a subsurface parameter such as pressure is telemetered to the surface via the conductors of a power cable by superposition of the telemetry data onto the power signals. At the surface the signal is demodulated to produce a signal indicative of the transmitted parameter.

SUMMARY OF THE INVENTION

It is therefore an object of this invention to provide a more sensitive method for detecting gas kicks which comprises comparing a measured drilling mud density with a predicted mud density.

It is another object of this invention to sense the onset of gas kicks at a point just above the blowout preventer so that they may be more readily controlled.

It is another object of this invention to use an absolute pressure measurement at the instrumented riser section to calibrate the sensed differential pressure based upon depth and the measured pressure loss resulting from flow losses through the riser.

It is another object of this invention to compare the mud density in a riser section near the blowout preventer to the average density of mud in the riser as determined by an absolute pressure measurement across the entire riser above the blowout preventer.

According to the invention, both the differential pressure and the absolute pressure are measured at a point just above the blowout preventer in a marine riser. The differential pressure measurement is used to directly monitor the density of drilling mud at the point above the blowout preventer in the riser. The absolute pressure is used to compute the average mud density baseline in the whole riser length. If the differential mud density measurement indicates a mud mix above the BOP to be less dense than the average (baseline value) by a substantive amount, a gas or other foreign fluid less dense than the mud has mixed with the mud entering the riser and control procedures should be commenced.

An alternate or correlative method of obtaining a baseline mud density is by frequent measurement of the weight of the mud and the rate of the mud being pumped down the drill string and the hole depth. With available knowledge of the capacities of the drilling system (drill pipe, open hole, well casings and annuli), it is possible to predict the density of the mud in the riser at the point just above the blowout preventer as a function of time. If gas is present in the mud, the locally measured density of the mud will be lower than expected and the measured and the predicted or baseline values of density will not compare. Telemetry equipment is used to notify an operator at the sea surface of the onset of a gas kick when an unfavorable comparison of measured and predicted or baseline values is found. In addition to gas kicks, the influx of other formation fluids as well as lost circulation conditions can be determined using this invention.

BRIEF DESCRIPTION OF THE DRAWINGS

The foregoing and other objects, aspects and advantages of the invention will be better understood from the following detailed description of the preferred embodiment of the invention with reference to the accompanying drawings, in which.

DETAILED DESCRIPTION OF THE PREFERRED EMBODIMENT OF THE INVENTION

Figures 1A, 1B:
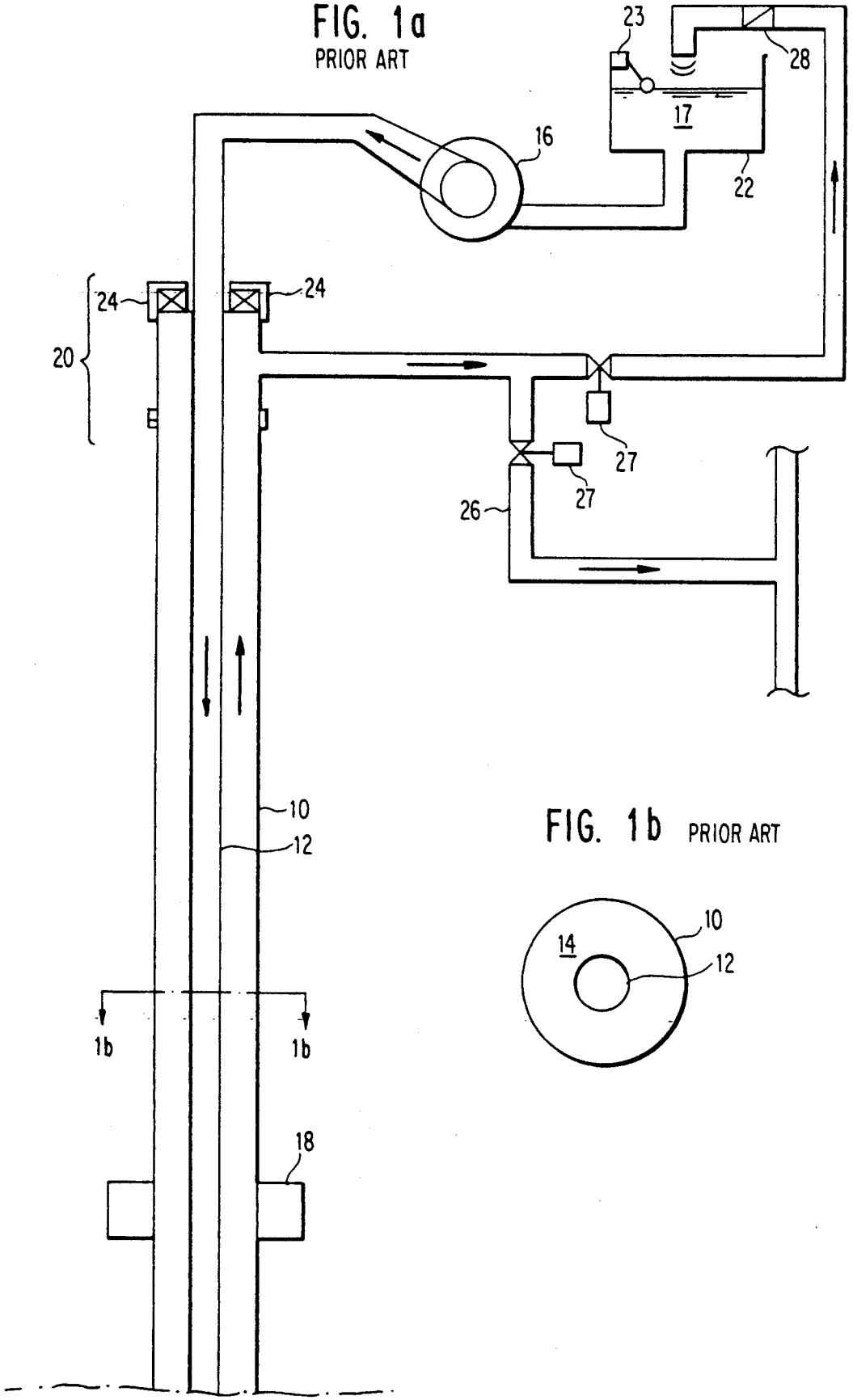
FIG. 1a PRIOR ART
FIG. 1b PRIOR ART
FIG. 1*a* is a cross-sectional side view of a marine riser and mud pump arrangement.
FIG. 1*b* is a cross-sectional top view taken along line 1*b*—1*b* in FIG. 1*a* showing the drill string positioned within the riser.

Referring now to the drawings and, more particularly to FIGS. 1*a* and 1*b* which illustrate the basic operation of a marine riser in an offshore drilling operation, a riser 10 extends from the ocean floor to the sea surface and is comprised of many sections fitted together. A drill string 12 positioned inside the riser 10 serves as a conduit for pumping drilling mud down to a drill bit (not shown) that operates beneath the ocean floor. FIG. 1*b* shows that the drill string 12 is positioned in the center of the riser 10. The outside diameter of the drill string 12 and the inside diameter of the riser 10 define an area 14, which is referred to as the annulus 14. In practice, the drill string 12 is not perfectly centered, but may reside anywhere within the interior of the riser 10.

Referring back to FIG. 1*a*, the offshore drilling operation is performed by using a mud pump 16 to pump drilling fluids 17 such as drilling mud down the drill string 12 to flush cuttings from the drill bit. The cuttings mixed with the drilling mud circulate back up the riser 10. A blowout preventer 18, controlled from the surface, is positioned near the ocean floor to prevent uncontrolled fluid flow during periods when the hydrostatic head of the mud is insufficient to control formation pressures. At the sea surface, the drilling mud 17 from the riser 10 passes through a diverter assembly, shown generally as 20, into a mud tank 22 where the cuttings are separated from the drilling mud. A pit level sensor 23 is used to monitor the level of drilling mud in the mud tank 22. The mud pump 16 then re-circulates the drilling mud back down the drill string 12 for further use. In the event gas enters the riser 10 and threatens to flow uncontrolled at the surface, the packers 24 can be closed around the drill string 12 to seal off the annular clearance to the rig floor and valves 27 divert violent flow to the overboard diverter 26 which passes it harmlessly overboard on the downwind side of the drilling vessel. The dynamics of gas rising in the riser annulus 14 are such that by the time ordinary detection means, such as a flow sensor 28, are effective, the gas has risen to the surface and entered the floor before the overboard diverter 26 can be activated.

Figure 2:
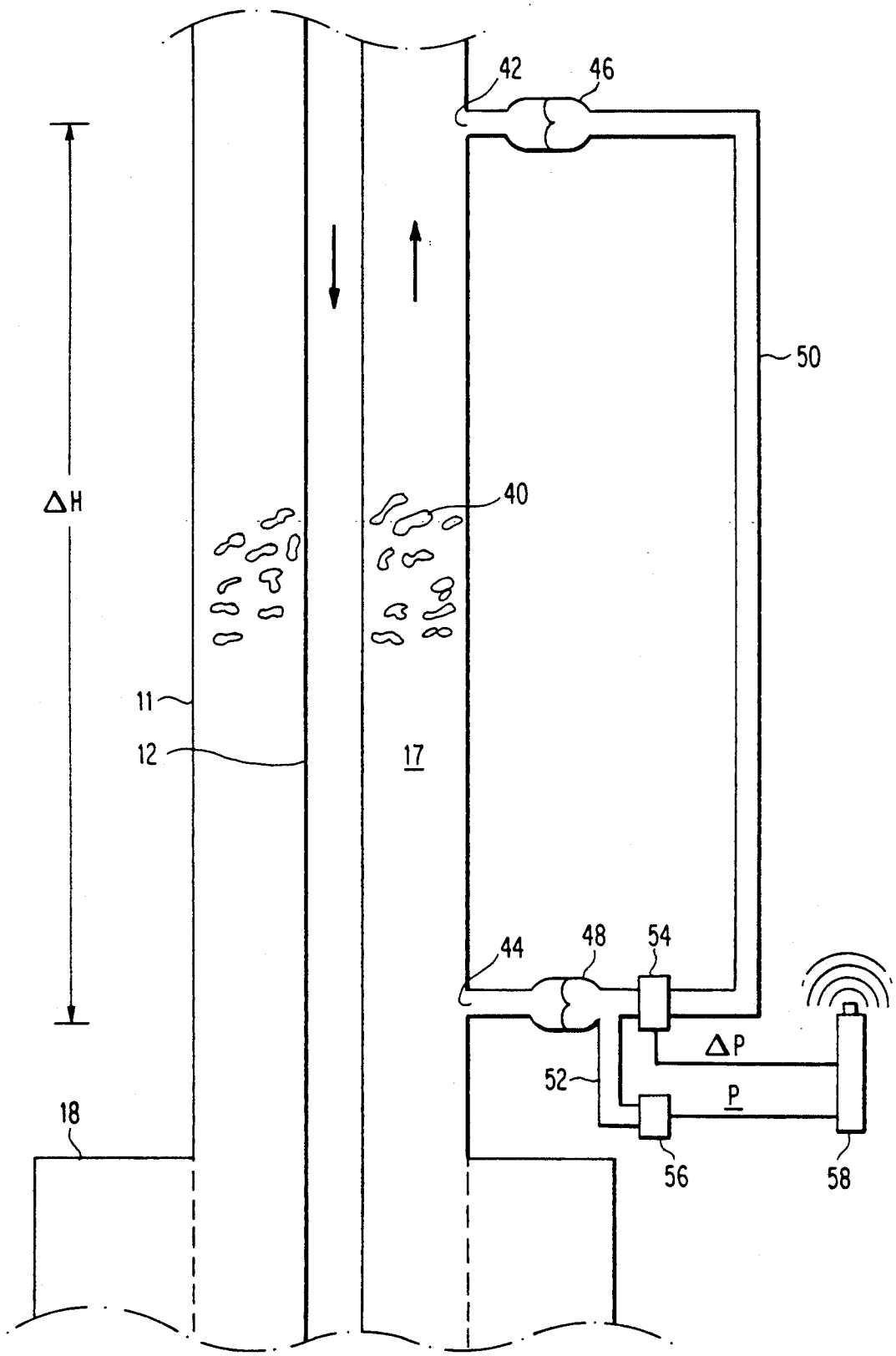
FIG. 2 is a cross-sectional side view of a riser section showing the differential pressure detection instrumentation.

FIG. 2 shows the inventive monitoring equipment positioned to monitor the absolute pressure and the differential pressure in a riser section 11 at point just above the blowout preventer 18. The riser section 11 is the lower section of a riser (riser 10 in FIG. 1*a*) and is typically 50 to 100 feet long. The riser section 11 is located several hundred or several thousand feet below sea level. The absolute pressure gives a measure of the average weight of the mud in the whole riser and can be used as a baseline for calibrating the expected value for the differential pressure. The differential pressure gives a measure of the density of the mud or mud/gas mix in the riser section 11 being monitored.

The monitoring equipment is connected to the riser section 11 via an upper orifice 42 and a lower orifice 44. Diaphragm chambers 46 and 48 are positioned at the inlet sides of orifices 42 and 44, respectively. A connecting arm 50 extending from diaphragm chamber 42, and filled with a fluid of known density, such as fresh water, spans the vertical separation distance ΔH between the orifices 42 and 44. A suitable vertical separation is fifty feet. Connecting arm 52 extending from diaphragm chamber 48 is filled with a fluid of known density, and the fluid is preferably water. A differential pressure transducer 54 is positioned between connecting arms 50 and 52. At a 6,000 foot depth and operating with 18 pounds per gallon mud weight, a suitable differential pressure transducer 54 may have a dynamic range of ±30 pounds per square inch (psi) and should be capable of operating at a 5,600 psi ambient pressure. At deeper operating depths, higher ambient pressure transducer ratings must be provided. An absolute pressure transducer 56 is positioned at an end of connecting arm 52. Similar to the differential pressure transducer 54, the absolute pressure transducer 56 is selected for the dynamic range and operating parameters required by the mud weight and operating depth.

The differential pressure, ΔP, is equal to the pressure exerted at lower orifice 44 minus the sum of the pressure exerted at upper orifice 42 and the column pressure exerted by the column of water in connecting arm 50. The absolute pressure, $\underline{P}$, is the pressure measured at the lower orifice 44. The sensed differential pressure, ΔP, and the sensed absolute pressure, $\underline{P}$, are sent to an operator at the sea surface using wire communications, fiber optics, or acoustic techniques. Preferably, the differential pressure transducer 54 and absolute pressure transducer are wired to an acoustic telemetry beacon 58 which sends the differential pressure, ΔP, and absolute pressure, $\underline{P}$, information by pulse position modulation or some other suitable acoustic telemetry technique. The cost of electric and fiber optic lines and possible entanglement problems associated with connecting an electric or fiber optic cable directly to the pressure sensors, 54 and 56, may be avoided using acoustic techniques; however, in some environments a direct connection may be preferred.

In a first embodiment of the invention, the average density of drilling mud in riser section 11, $\eta_{11}$, is compared with the average density of drilling mud in the whole riser 10, $\eta_{10}$. If mud of uniform density is used for drilling, the ratio will be constant when no gas is entrained in the mud. At the onset of a gas kick, the ratio will change rapidly because the percentage of gas in the riser section 11 will be far greater than the percentage of gas in the whole riser 10. The relative volumes of riser section 11 compared with the whole riser 10 dictate that the same volume of gas will have a greater effect on the riser section 11 than the whole riser 10.

The average density of the mud or mud/gas mixture in riser section 11, $\eta_{11}$, can be obtained from the differential pressure determined by sensor 54 according to the following equation:

$$\Delta P = \eta_{11}\Delta H - \eta_w \Delta H$$

solving for $\eta_{11}$:

$$\rho_{11} = \frac{\Delta P}{\Delta H} + \rho_w$$

where

ΔP is the measured differential pressure obtained from sensor 54;

ΔH is the vertical distance between orifice 42 and 44; and $\eta_w$ is the density of fluid in connecting arm 50 (presumably water).

The average density of the mud or mud/gas mixture in the whole riser 10, $\eta_{10}$, can be obtained from the absolute pressure determined by sensor 56 according to the following equation:

$$\underline{P} = \eta_{10} D + P_E$$

solving for $\eta_{10}$:

$$\rho_{10} = \frac{P - P_E}{D}$$

where $\underline{P}$ is the measured absolute pressure obtained from sensor 56;

D is the depth to orifice 44 relative to the surface exit port; and $P_E$ is the absolute exit pressure which is usually atmospheric pressure.

Comparing the average density of the mud or mud/gas mixture in riser section 11, $\eta_{11}$, computed from the differential pressure sensor 54 with the average density of the mud or mud/gas mixture in the whole riser 10, $\eta_{10}$, computed from the absolute pressure sensor 56 can provide an indication of the onset of a gas kick.

The mathematical relationship between the differential pressure measurement and the density of gas and mud is the following:

$$\Delta P=\eta_m(\Delta H-V_G/A)+\eta_G V_G/A-\eta_w \Delta H$$

where $\Delta P$ is the measured differential pressure;

$\Delta H$ is the vertical separation of orifices 42 and 44;

$V_G$ is the volume of compressed gas 40 between the two orifices 42 and 44;

A is the area dimension of the annulus 14;

$\eta_m$ is the density of mud without gas;

$\eta_G$ is the density of compressed gas; and $\eta_w$ is the density of fluid in the connecting arm 50.

Figure 3:
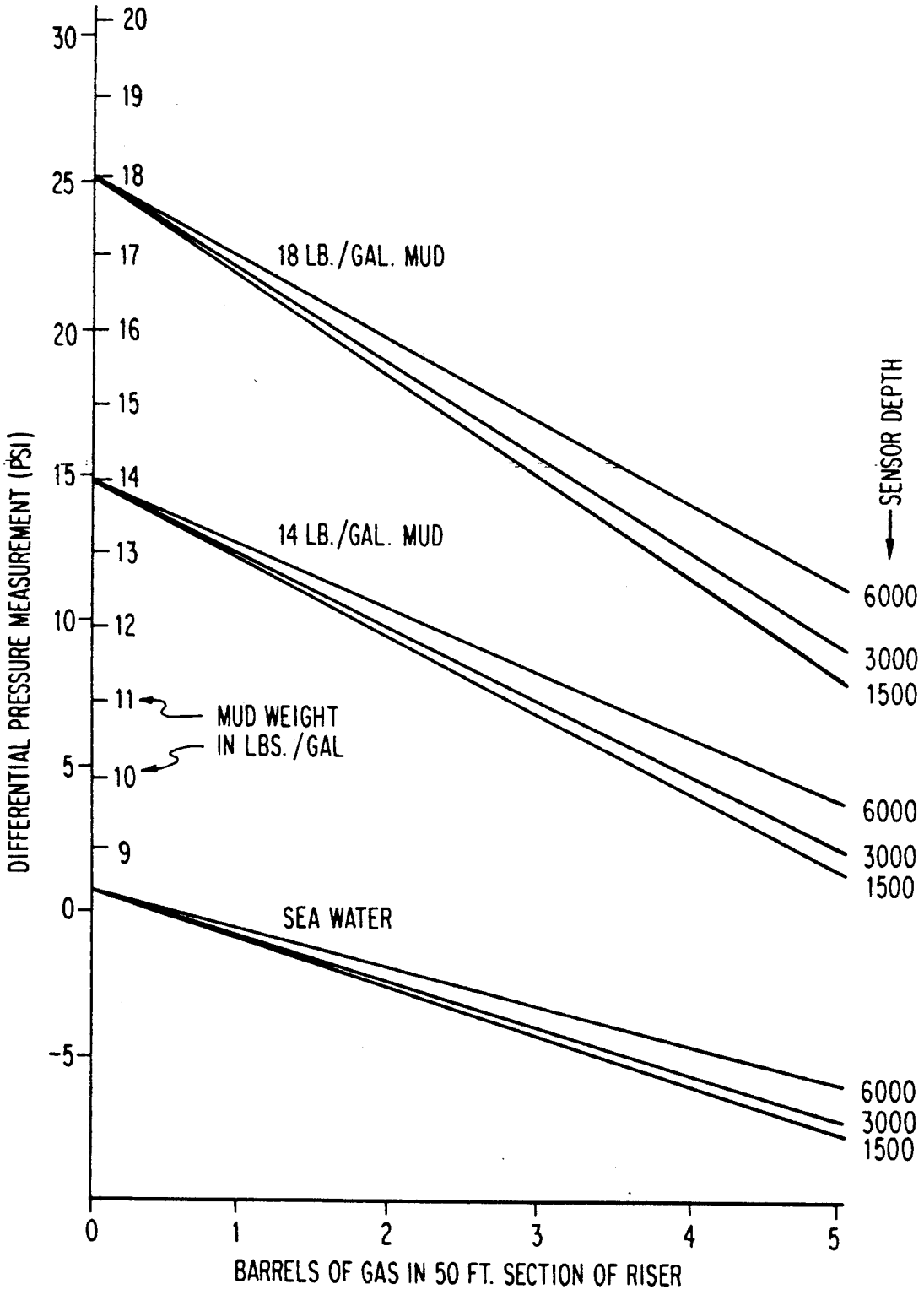
FIG. 3 is a graph showing calculated values indicative of the relationship between differential pressure and gas volume in a fifty foot section of a seventeen and one quarter inch inside diameter (ID) riser.
Figure 4:
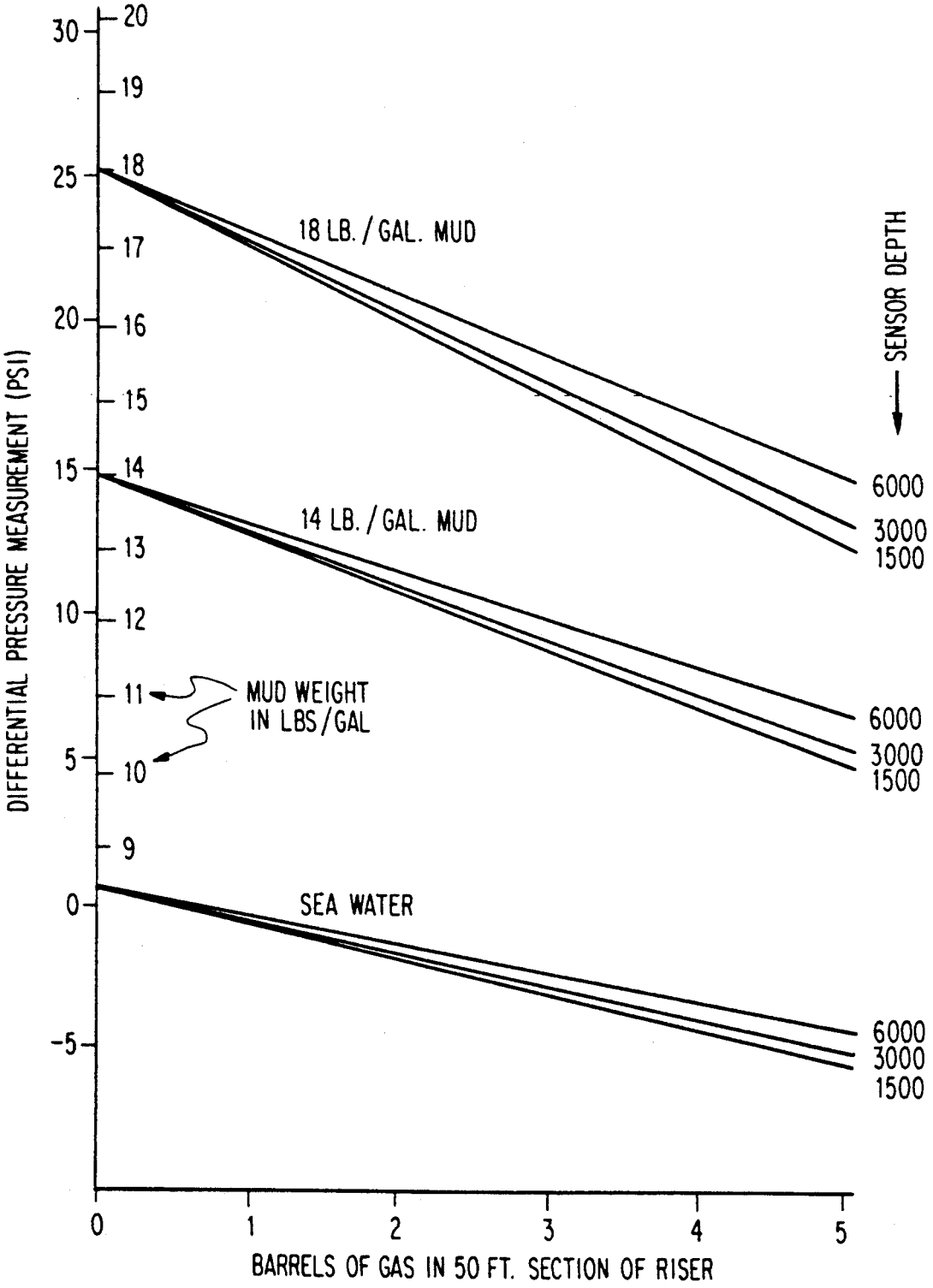
FIG. 4 is a graph showing calculated values indicative of the relationship between differential pressure and gas volume in a fifty foot section of a nineteen and three quarter inch ID riser.

Referring to FIGS. 3 and 4, calculations based on the above equations have been made which predict the differential pressure, $\Delta P$, measurement as a function of the influx of gas in the mud in the riser above the blowout preventer for two different riser diameters. The calculations considered the weight of mud being pumped down the drill string and the sensor depth. FIG. 3 shows the differential pressure measurement which would be found in a 50 foot section of a 17.25 inch diameter riser where the drill pipe has a 6 inch outside diameter. Calculations have been made for drilling mud densities of 18 pounds per gallon (lbs/gallon) and 14 lbs/gallon. In addition, calculations have been made for sea water used as the drilling fluid. Drilling is assumed to be conducted with a uniform mud density having a variation of less than ±0.1 lbs/gallon. In the calculations, the gas density, $\eta_G$, was computed based upon compressed gas having an assumed density of 0.09302 lbs/foot$^3$ at sea level and 0° C. It was assumed that the gas temperature at the blowout preventer was 120° F. and that the riser was open at the surface. The flow rate pressure drop, which is a function of the viscosity of the mud and the flow rate, was not included in the calculations because it was estimated to be less than 1 psi in the measured differential pressure. FIG. 4 shows the results of the same calculations used for obtaining FIG. 3 except the differential pressure for a 19.75 inch riser was predicted. Analysis of the graphs in FIGS. 3 and 4 show that a higher mud density will have a greater detection sensitivity (this is a function of the slope of the graphs). It was also found that the gas density increase caused by the gas being compressed from the mud column weight has only a small effect on detection sensitivity down to 6000 feet.

Figure 5:
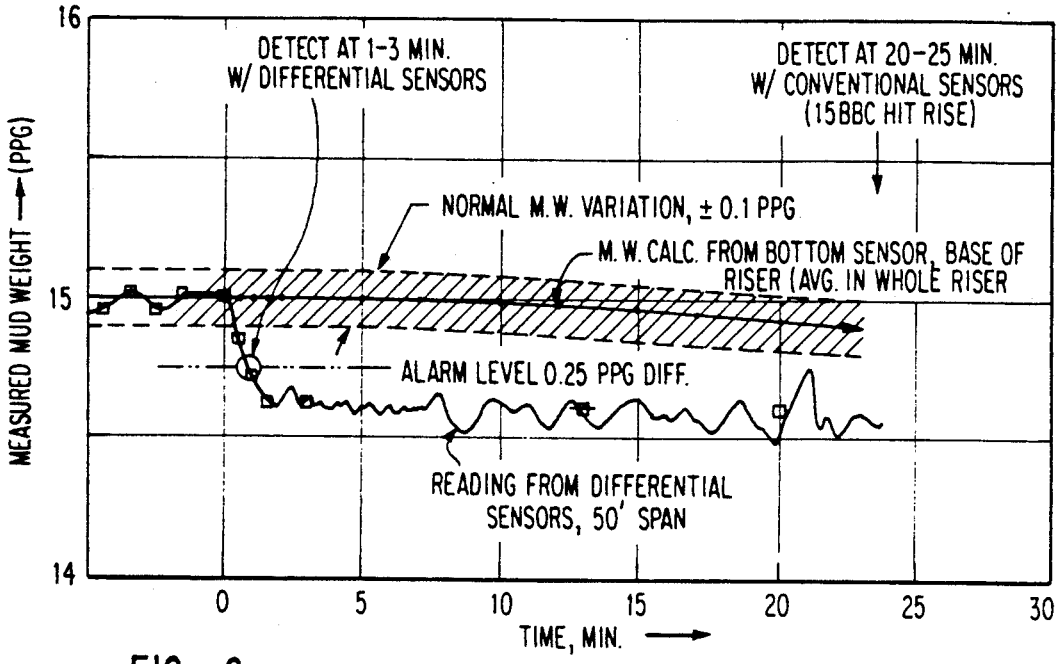
FIG. 5 is a graph of the response time of the inventive monitoring apparatus for one embodiment.

FIG. 5 shows the predicted values of the baseline mud weight that would be calculated from an absolute pressure sensor at the bottom of a riser versus the readings from differential pressure sensors positioned fifty feet apart at the same location at the bottom of a riser in the following situation: a 10 inch hole is being drilled at an 8000 foot depth, a 19.75 inner diameter riser extends to a 4000 foot water depth, the mud weight is nominally 15 lbs/gallon, and approximately 0.5 barrels of gas are in the riser segment having the fifty foot sensor span (2.6%) with continuous flow of the gas into the riser from time T=0 onward. Both are plotted versus time from the commencement of gas entry into the riser. Values are predicted from a realistic mathematical modeling of the process of mud pumping and gas intrusion, mixing of the gas with the mud, and expansion of the gas as it moves upwards (pressure is reduced as gas moves upwards). Any realistic mathematical model of this process would yield approximately the same results. A normal scatter of mud weight due to passage of slightly higher or lower density portions of the total mud system is accounted for by the band of plus or minus 0.1 lb/gal about the predicted value of the baseline mud weight, and by the probable random variation of the differential reading from the predicted values. This depicts the more or less random "noise" in the system due to real world probable events. Even so, it is apparent that a clear departure of differential measurement from baseline measurement would occur, and that an alarm level could be set in the system to detect the presence of gas after as little as one minute. With conventional detection schemes, detection does not occur for twenty to twenty five minutes.

In a second embodiment of the invention, the density of the drilling mud in the lower riser section 11 is compared with a predicted value. The density in the lower riser section corresponds to the differential pressure detected by sensor 54. If formation gas enters the riser section 11, the density of the mud will be lowered and the measured differential pressure will be different from the expected differential pressure. The discrepancy between the two values is indicative of the onset of a gas kick. The amount the differential pressure changes with gas volume is a function of the depth, volumetric parameters, gas temperature, and mud density. The specific volume of gas entering the riser section can be determined from the measured differential pressure and the operating parameters. A threshold volume of gas entering the riser is programmed to provide an alarm condition signifying the onset of a gas kick.

The use of a mud flow dynamics model for predicting the expected down hole differential pressure is required when the density of the mud being pumped down the drill string is not uniform or is frequently being changed. For example, if the mud density is reduced at the input to the mud pump, it could take an hour before this mud is circulated through the system where it will be detected at the differential pressure sensor in a deep well. The time delay is easily accounted for from knowing the approximate volumetric parameters of the well and the rate of pumping of the circulated mud. The mud mixing effect can be either modeled or computed from experimental tests.

Figure 6:
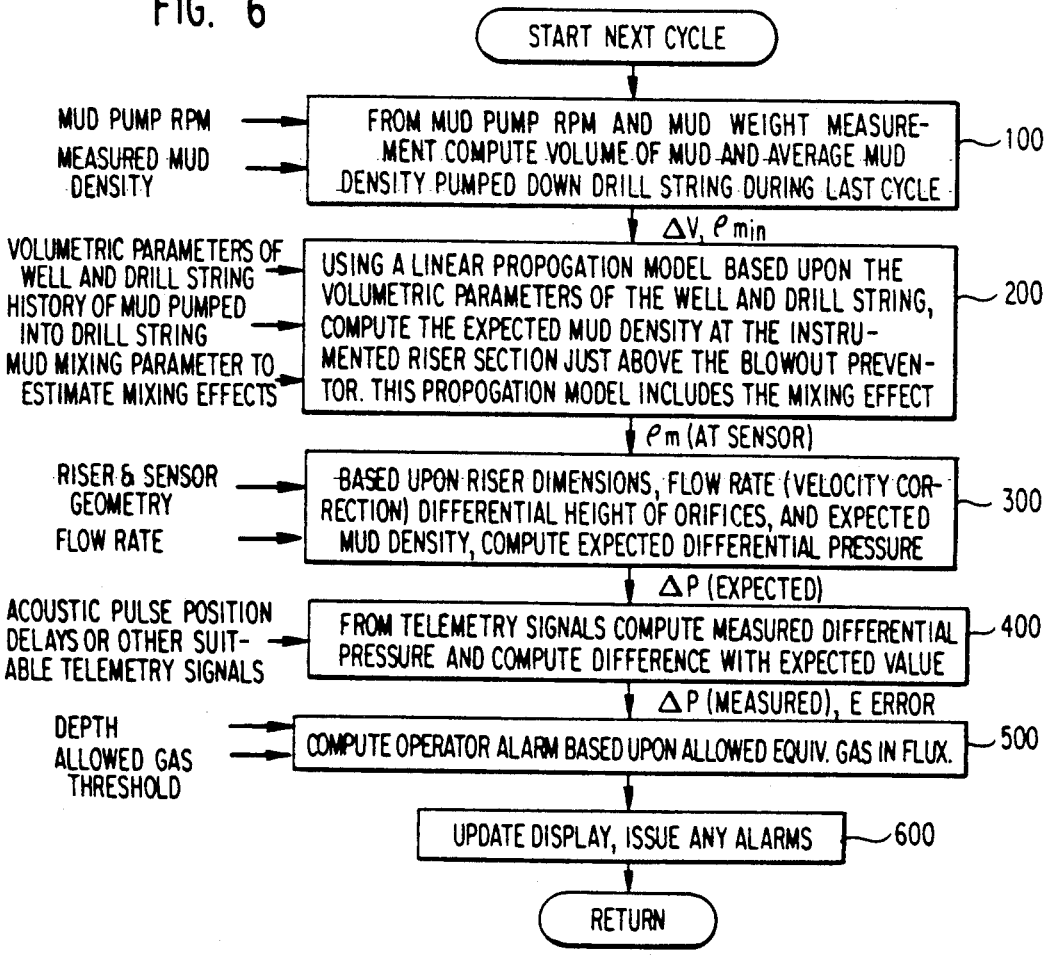
FIG. 6 is a flow diagram of a program executed by the computer controller to calculate an expected differential pressure, then to compare the measured differential pressure with the expected differential pressure, and to issue an alarm if an unfavorable comparison is found.
Figure 7A:
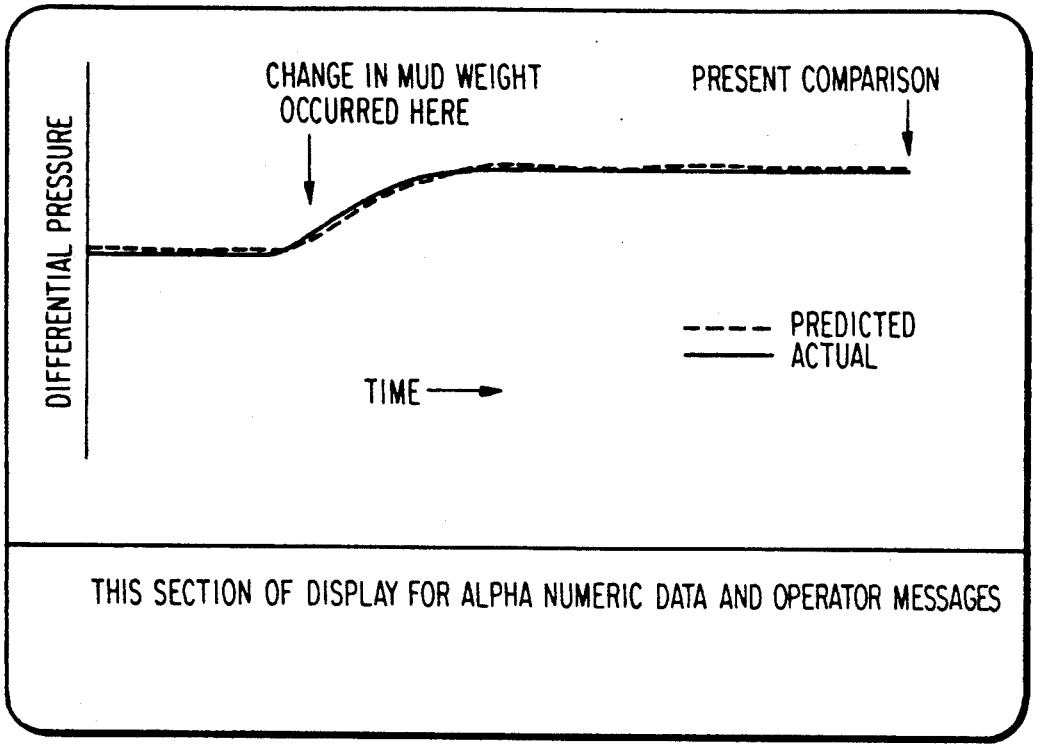
FIG. 7*a* is a computer display showing the monitored relationship of the predicted and measured differential pressures where the two values have overlapped one another.
Figure 7B:
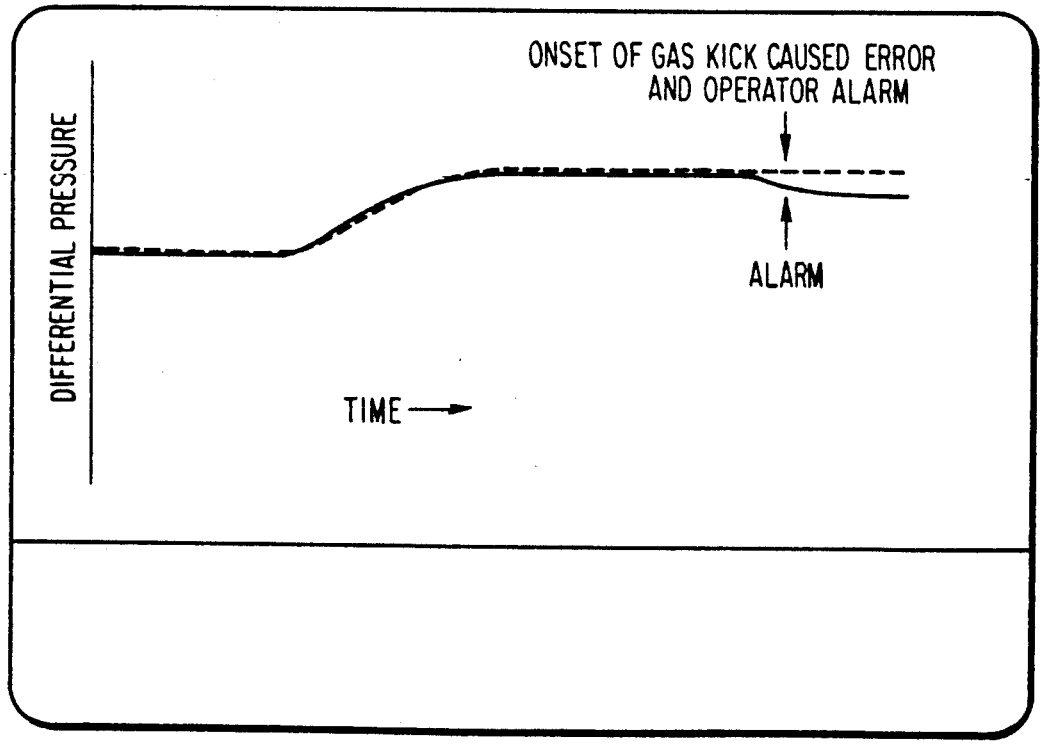
FIG. 7*b* is a computer display showing the monitored relationship of the predicted and measured differential pressures where the onset of a gas kick has been found and an alarm has been given.

FIG. 6 shows a computer flow chart which may be used in the practice of this invention. In step 100, the mud pump rpms and measured mud weight are used to calculate the volume of mud and the average mud density pumped down the drill string. In step 200, the expected mud density at the riser section just above the blowout preventer is calculated (note that a properly designed mud flow dynamics model can predict conditions at any point in the circulation). In computing the expected mud density, the volumetric parameters of the well and drill string, the history of the mud pumped down the drill string, and mud mixing effects are considered. The riser section above the blowout preventer includes the subsea instrumentation comprising the differential pressure sensor and the absolute pressure sensor. In step 300, the expected mud density is used to calculate the expected differential pressure. The expected differential pressure is a function of riser dimensions, mud flow rate, expected mud density, and the vertical separation of the orifices in the riser. In step 400, the measured differential pressure is determined from telemetered data and compared with the expected differential pressure. In step 500, any difference resulting from the comparison of the measured and predicted values is compared with a threshold value for gas influx. An appreciable amount of gas influx could be set at one barrel of gas such that quantities of gas entering the riser that are less than one barrel will not trigger an alarm condition. In step 600, the computer display at the surface is updated and alarms are given if required. The above described process can be repeated several times each minute and the history of a drilling operation can be stored by the computer. A continuous update is appropriate at each measurement of absolute pressure and differential pressure.

FIGS. *7a* and *7b* illustrate how the information obtained during a drilling operation using the inventive apparatus may be displayed. In both FIG. *7a* and *7b*, the predicted differential pressure is shown as a dashed line and the measured differential pressure is shown as a solid line. The displays show that a change in the density of the drilling mud being pumped down the drill string can be modeled such that the measured and predicted differential pressures continue to track one another. In FIG. *7a*, an appreciable amount of gas has not entered the riser and; therefore, the measured and predicted values are overlapping for the entire run. In FIG. *7b*, an appreciable amount of gas has entered the riser and this is reflected by the measured differential pressure dropping below the expected differential pressure towards the end of the run. The display may have a section dedicated for alpha-numeric information presentation. A visual alarm as well as remedial procedures to be performed by the operator at the surface may be given in the alpha-numeric data section. Audible alarms are given to aid in alerting an operator.

While the invention has been described in terms of the preferred embodiments which include comparing the density of drilling fluid in a lower riser section with the density of drilling fluid in the entire riser or comparing a predicted down hole differential pressure obtained from a mud flow dynamics model with a measured down hole differential pressure, those skilled in the art will recognize that there are obvious extensions and variations within the spirit and scope of the appended claims.

Having thus described our invention, what we claim as novel and desire to secure by letters patent is the following;

1. A method for detecting a gas kick during drilling, comprising the steps of:

determining a first average density of drilling mud in a marine riser, said marine riser being comprised of a plurality of riser sections extending from an ocean floor to a sea surface;

determining a second average density of drilling mud in an instrumented riser section of said marine riser, said instrumented riser section being positioned near said ocean floor in said marine riser; and comparing said first average density with said second average density whereby a rapid change in a ratio of said first average density to said second average density is indicative of a gas kick.

2. A method as recited in claim 1 wherein said step of determining said first average density includes the steps of:

measuring an absolute pressure exerted by a column of mud in said marine riser at said instrumented riser section; and calculating said first average density from the measured absolute pressure;

and wherein said step of determining said second average density includes the steps of:

measuring a differential pressure exerted across said instrumented riser section by said column of mud; and calculating said second average density from the measured differential pressure.

3. A method as recited in claim 2 further comprising the step of telemetering said measured absolute pressure and said measured differential pressure from sensors connected to said instrumented riser section to control instrumentation positioned at said sea surface.

4. A method as recited in claim 3 wherein said step of telemetering is performed acoustically.

5. A method as recited in claim 1 further comprising the step of alerting an operator of a gas kick when said rapid change in said ratio exceeds a threshold value.

6. A method for detecting a gas kick during drilling, comprising the steps of:

measuring a differential pressure measurement across an instrumented riser section in a marine riser, said marine riser being comprised of a plurality of riser sections extending from an ocean floor to a sea surface, said instrumented riser section being positioned near said ocean floor in said marine riser;

predicting an expected density of drilling mud in said instrumented riser section based upon a mud flow dynamics model;

calculating an expected differential pressure measurement from said expected density of drilling mud; and comparing said measured differential pressure measurement with said expected differential pressure measurement whereby a difference above a threshold value indicates the onset of a gas kick.

7. A method as recited in claim 6 further comprising the step of telemetering said measured differential pressure measurement to a control station at said sea surface, said step of comparing being performed at said sea surface.

8. A method as recited in claim 6 further comprising the step of displaying the measured differential pressure measurement and the expected differential pressure measurement on a common display.

9. An apparatus for detecting a gas kick during drilling, comprising:

means for determining a first average density of drilling mud in a marine riser, said marine riser being comprised of a plurality of riser sections extending from an ocean floor to a sea surface;

means for determining a second average density of drilling mud in an instrumented riser section of said marine riser, said instrumented riser section being positioned near said ocean floor in said marine riser; and means for comparing said first average density with said second average density whereby a rapid change in a ratio of said first average density to said second average density is indicative of a gas kick.

10. An apparatus as recited in claim 9 wherein said means for determining said first average density includes:

means for measuring an absolute pressure measurement indicative of the absolute pressure exerted by a column of mud in said marine riser at said instrumented riser section; and means for calculating said first average density from said absolute pressure measurement;

and wherein said means for determining said second average density includes:

means for measuring a differential pressure measurement indicative of the differential pressure exerted across said instrumented riser section by said column of mud; and means for calculating said second average density from said differential pressure measurement.

11. An apparatus as recited in claim 10 further comprising a means for telemetering said absolute pressure measurement and said differential pressure measurement from sensors connected to said instrumented riser section to control instrumentation positioned at said sea surface.

12. A method as recited in claim 11 wherein said means for telemetering is an acoustic beacon.

13. An apparatus as recited in claim 9 further comprising a means for alerting an operator of a gas kick when said rapid change in said ratio exceeds a threshold value.

14. An apparatus for detecting a gas kick during drilling, comprising:

means for measuring a differential pressure measurement across an instrumented riser section in a marine riser, said marine riser being comprised of a plurality of riser sections extending from an ocean floor to a sea surface, said instrumented riser section being positioned near said ocean floor in said marine riser;

means for predicting an expected density of drilling mud in said riser section based upon a mud flow dynamics model;

means for calculating an expected differential pressure measurement from said expected density of drilling mud; and means for comparing said measured differential pressure measurement with said expected differential pressure measurement whereby a difference above a threshold value indicates the onset of a gas kick.

15. An apparatus as recited in claim 14 wherein said means for comparing said measured differential pressure measurement with said expected differential pressure measurement is located in a control station at said sea surface and further comprising a means for telemetering said measured differential pressure measurement to said control station at said sea surface.

16. A method as recited in claim 14 further comprising a means for displaying said measured differential pressure measurement and said expected differential pressure measurement on a common display.

17. A method as recited in claim 14 wherein said threshold value is selectable and corresponds to a particular volume of gas.

* * * * *

UNITED STATES PATENT AND TRADEMARK OFFICE

CERTIFICATE OF CORRECTION

PATENT NO. : 5,006,845

DATED : April 9, 1991

INVENTOR(S) : Henry Van Calcar and Gary L. Marsh

It is certified that error appears in the above-identified patent and that said Letters Patent is hereby corrected as shown below:

Col. 11, line 15, change "A method" to --An apparatus--.

Col. 12, line 20, change "A method" to --An apparatus--.

Col. 12, line 24, change "A method" to --An apparatus--.

Signed and Sealed this

Twenty-fifth Day of August, 1992

*Attest:*

DOUGLAS B. COMER

*Attesting Officer*

*Acting Commissioner of Patents and Trademarks*